US005259353A

United States Patent [19]

Nakai et al.

[11] Patent Number: 5,259,353

[45] Date of Patent: Nov. 9, 1993

[54] FUEL EVAPORATIVE EMISSION AMOUNT DETECTION SYSTEM

[75] Inventors: Kazuhiro Nakai, Kariya; Akihiro Nakashima, Chiryu; Hisashi Iida, Ama, all of Japan

[73] Assignee: Nippondenso Co., Ltd., Kariya, Japan

[21] Appl. No.: 866,057

[22] Filed: Apr. 10, 1992

[30] Foreign Application Priority Data

Apr. 12, 1991 [JP] Japan ..... 3-079763

[51] Int. Cl.[5] ..... F02M 33/02

[52] U.S. Cl. ..... 123/518; 123/520

[58] Field of Search ..... 123/516, 518, 519, 520, 123/521, 698; 73/118.1

[56] References Cited

U.S. PATENT DOCUMENTS

| | | | |
|---|---|---|---|
| 4,748,959 | 6/1988 | Cook et al. | 123/520 |
| 4,794,790 | 1/1989 | Bosch | 73/117.3 |
| 4,862,856 | 9/1989 | Yokoe et al. | 123/519 |
| 4,926,825 | 5/1990 | Ohtaka et al. | 123/520 |
| 4,945,885 | 8/1990 | Gonze et al. | 123/520 |
| 4,949,695 | 8/1990 | Uranishi et al. | 123/520 |
| 5,044,341 | 9/1991 | Henning et al. | 123/520 |
| 5,072,712 | 12/1991 | Steinbrenner et al. | 123/520 |
| 5,111,796 | 5/1992 | Ogita | 123/520 |
| 5,150,689 | 9/1992 | Yano et al. | 123/520 |
| 5,158,054 | 10/1992 | Otsuka | 123/520 |

FOREIGN PATENT DOCUMENTS

| | | |
|---|---|---|
| 57-32059 | 2/1982 | Japan . |
| 2-102360 | 4/1990 | Japan . |
| 2-136558 | 5/1990 | Japan . |
| 3-26862 | 2/1991 | Japan . |

*Primary Examiner*—E. Rollins Cross
*Assistant Examiner*—Thomas Moulis
*Attorney, Agent, or Firm*—Cushman, Darby & Cushman

[57] ABSTRACT

A detecting system for condition of a fuel evaporative emission generated in a fuel tank, includes a pressure sensor and a three-way valve for selectively connecting the pressure sensor to atmosphere and the fuel tank. The pressure sensor is initially communicated with the atmosphere to detect an atmospheric pressure $P_a$ (step 110), and subsequently communicated with the fuel tank to detect an internal pressure $P_f$ of the fuel tank (step 130). Based on the atmospheric pressure $P_a$ and the internal pressure $P_f$ of the fuel tank, an amount EVP of the fuel evaporative emission generated in the fuel tank is derived through a map look-up against a preset map (step 150).

13 Claims, 9 Drawing Sheets

FUEL EVAPORATIVE EMISSION AMOUNT DETECTION SYSTEM

BACKGROUND OF THE INVENTION

The present invention relates to an evaporative emission control system in a fuel supply system of an automotive vehicle. More particularly, the invention relates to a system for detecting condition of a fuel evaporative emission which detects amount of the fuel evaporative emission generated in a fuel tank.

In general, evaporative emission control systems for presenting the fuel evaporative emission generated in the fuel tank from being discharged into atmosphere have not been in the automotive technologies. Such system generally absorbs the fuel evaporative emission generated in the fuel tank with an absorbent disposed within a canister, and subsequently supplies the absorbed fuel evaporative emission into an air induction system with a fresh air introduced through a fresh air inlet opening formed through the canister, by vacuum pressure in the air induction system, depending upon the driving condition of an engine.

In this type of evaporative emission control system, a pressure sensor is provided for detecting the internal pressure in the fuel tank and whereby for detecting amount of the fuel evaporative emission generated in the fuel tank (for example, in Japanese Unexamined Patent Publication (Kokai) No. 2-136558). In the conventional arrangement, the pressure sensor simply detects the pressure within the fuel tank to make judgement that the greater internal pressure of the fuel tank reflects greater amount of the fuel evaporative emission generated therein.

However, the internal space of the fuel tank is not completely sealed in gas tight fashion. Namely, the interior space of the fuel tank can be communicated with atmosphere through the fresh air inlet opening of the canister, or, in the alternative, temporarily opens to the atmosphere through a control valve disposed within the canister.

Therefore, the pressure within the fuel tank can be significantly influenced by the atmospheric pressure. Namely, irrespective of generation of the fuel evaporative emission, the pressure within the fuel tank can be fluctuated by the atmospheric pressure.

Accordingly, in the above-mentioned method (the method to simply detect the internal pressure within the fuel tank and to derive the fuel evaporative emission generation amount on the basis of the internal pressure in the fuel tank), erroneous detection can be caused to make judgement that a large amount of the fuel evaporative emission is generated despite of the fact that a small amount of fuel evaporative emission is indeed generated, when the pressure is risen by the influence of the atmospheric pressure as set forth above.

Conversely, if the pressure in the fuel tank is lowered by the influence of the atmospheric pressure, erroneous detection of that small amount of fuel evaporative emission is generated despite of the fact that large amount of fuel evaporative emission is indeed generated, can be caused. Reference may be made to copending U.S. Patent application entitled "Self-diagnosis system in evaporated fuel gas distribution preventing system" filed on basis of Japanese patent application No. 3-75413 (of the filing date Apr. 8, 1991); and copending U.S. patent application entitled "Gaseous fuel flow rate detecting system" filed on basis of Japanese patent application No. 3-75414 (of the filing date Apr. 8, 1991), respectively filed in behalf of Nippon Denso Co., Ltd. (the assignee of the present application).

SUMMARY OF THE INVENTION

The present invention intends to solve the problems set forth above. Therefore, it is an object of the present invention to provide a detection system for a condition of a fuel evaporative emission, which can accurately detect amount of the fuel evaporative emission irrespective of fluctuation of the internal pressure in a fuel tank by the influence of the atmospheric pressure.

In order to accomplish above-mentioned and other objects, a system for detecting condition of a fuel evaporative emission generated in a fuel tank, according to one aspect of the invention, comprises:

atmospheric pressure detecting means for detecting atmospheric pressure;

tank internal pressure detecting means for detecting pressure within the fuel tank which receives a liquid state fuel;

fuel evaporative emission generation amount detecting means for detecting generated amount of the fuel evaporative emission in the fuel tank on the basis of the result of detection of the atmospheric pressure detection means and the result of detection of the tank internal pressure detecting means.

In a preferred construction, the system for detecting condition of a fuel evaporative emission comprises:

pressure detecting means for detecting a pressure;

a three-way switching valve including a first connecting section opened to outside atmosphere, a second connecting section connected to the fuel tank, a third connecting section connected to the pressure detecting means for selectively communicating the atmosphere and the fuel tank to the pressure detecting means;

control signal output means for outputting a control signal to the three-way switching valve for switching position thereof; and the fuel evaporative emission generation amount detecting means controlling the three-way switching valve to communicate the pressure detection means to the atmosphere to make the pressure detecting means to detect atmospheric pressure, controlling the three-way switching valve to communicate the pressure detecting means to the fuel tank to make the pressure detection means to detect the tank internal pressure, and detecting the generated amount of the fuel evaporative emission based on the atmosphere pressure and the tank internal pressure detected by the pressure detecting means.

DESCRIPTION OF THE PREFERRED EMBODIMENTS

Figure 1:
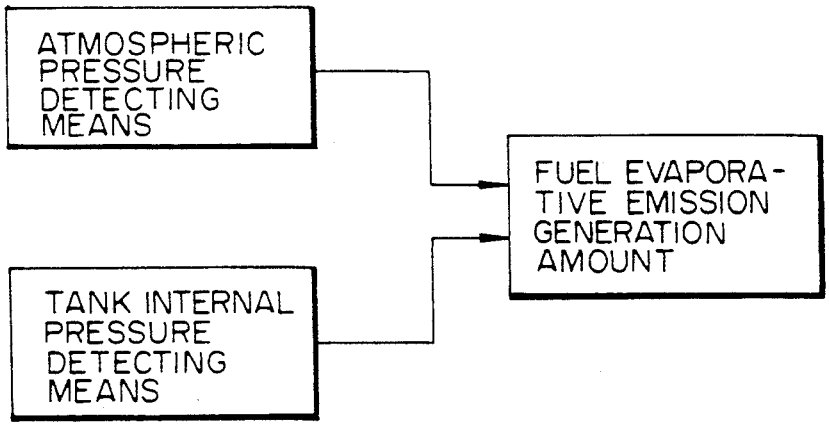
FIG. 1 is a schematic and diagrammatic illustration showing a general principle of the present invention.
Figure 2:
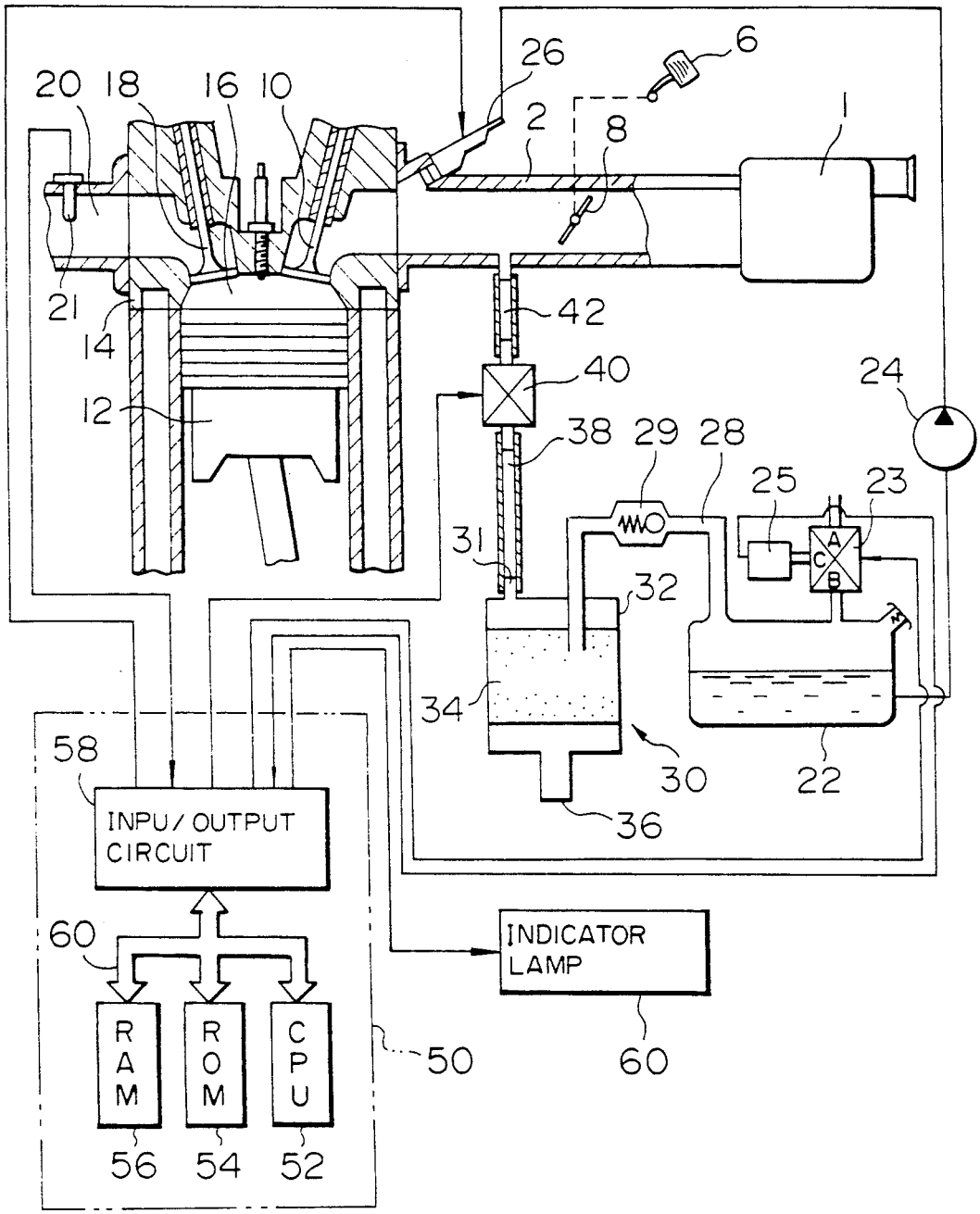
FIG. 2 is a diagrammatic illustration showing the overall construction of the preferred embodiment of an evaporative emission control system according to the present invention.

FIG. 2 shows the overall construction of the preferred embodiment of an evaporative emission control system for an internal combustion engine and an abnormality detecting system for the evaporative emission control system, which employs the fuel evaporative emission condition detecting system according to the present invention.

An intake air for the engine passes an air cleaner 1 for purifying the intake air and an air intake manifold 2 and then introduced into a combustion chamber 16 defined by an engine body 14 and a piston 12. A throttle valve 8 is disposed within the intake manifold 2, which throttle valve is coupled with an accelerator pedal 6 for varying the angular position to adjust the intake air flow path area depending upon depression magnitude of the accelerator pedal. An intake valve 10 is disposed in an intake port of the engine body 14, which the intake valve 10 is driven to open and close by means of a cam carried by a rotary camshaft (not shown).

An exhaust passage 20 is communicated with the combustion chamber 16 for exhausting a burnt gas generated in the combustion chamber 16 therethrough. An exhaust valve 18 is disposed in an exhaust port formed in the engine body 12 at an interface between the combustion chamber 16 and the exhaust passage 20, which exhaust valve is also driven by the rotary camshaft (not shown) for opening and closing. An oxygen sensor 21 is disposed within the exhaust passage 20 for detecting oxygen concentration contained within the exhaust gas, as a representation of rich and lean of an air/fuel mixture combustioned within the combustion chamber.

A fuel stored in a fuel tank 22 is sucked by a fuel pump 24 and delivered to a fuel injection valve 26 through a fuel supply system. The fuel injection valve 26 is disposed within the air intake manifold, i.e. in an intake manifold, and performs fuel injection for injecting a controlled amount of fuel at a controlled timing, as controlled by an electronic control system 50 which will be discussed later.

An absolute pressure sensor 25 forming the major part of the present invention is provided in the fuel tank 22 for monitoring the internal pressure within the fuel tank 22. The absolute pressure sensor 25 is associated with a three-way switching valve 23 and thus serves as an atmosphere pressure detecting means and a tank internal pressure detecting means. The three-way switching valve 23 performs switching to selectively establish communication between the absolute pressure sensor 25 with the interior space of the fuel tank 22 or the atmosphere under the control of the electronic control unit 50 discussed later. Furthermore, a communication passage 28 is connected to the fuel tank 22. A check valve 29 is provided within the communication passage 28. The check valve 29 is designed to responsive to the internal pressure of the fuel tank higher than or equal to a predetermined value $P_o$ ($P_o$=atmospheric pressure $+\alpha$ a is 15 mmHg, for example) to open to permit a fuel evaporative emission generated within the fuel tank 22 to pass therethrough and thus to introduce into a canister 30.

An absorbent 34 incorporating an activated carbon is disposed within the canister 30. The absorbent 34 absorbs the fuel evaporative emission contained in a gas introduced from the fuel tank 22 through the communication passage 28.

On the other hand, a fresh air inlet opening 36 is formed at one end of the canister 30 to introduce the atmospheric air therethrough. An outlet 31 is formed at the other end of the canister 30 opposing across the absorbent 34 to the fresh air inlet opening 36. A supply tube 38 is connected to the outlet 31 at one end.

The supply tube 38 is connected to a control valve 40 at the other end. The control valve 40 is, in turn, connected to one end of a supply tube 42 which is connected to the intake manifold 2 at the other end. Therefore, the canister 30 is communicated with the air intake manifold 2 through the control valve 40.

It should be noted that the supply tubes 38 and 42 are formed with a flexible tube, such as a rubber tube, nylon tube or so forth. On the other hand, the control valve 40 is controlled by the control signal from the electronic control unit 50 discussed later, to open and close for selectively establishing and blocking communication between the canister 30 and the air intake manifold 2.

The electronic control unit 50 (hereafter referred to as "ECU") sets control amount for a fuel system and an ignition system on the basis of various detection signals from various sensors (not shown) and produces control signals for controlling operation of the fuel injection valve 26, the control valve 40 and a spark ignition system (not shown). The operation of the ECU, in terms of control for the engine operation, e.g. fuel injection amount, fuel injection timing, spark ignition timing, spark advance angle and so forth depending upon the engine driving condition for optimizing the engine performance, is generally known in the art and need no further detailed discussion.

The ECU 50 includes a CPU 52 for performing known arithmetic operations, a ROM 54 for storing control programs, control constants necessary for arithmetic operations and so forth, a RAM 56 for temporarily storing arithmetic data during operation of the CPU 52 and an input/output circuit 58 for receiving and distributing signals from and to externally provided sensors and control loads, such as the fuel injection valve, the control valve and so forth.

The ECU 50 includes a control signal outputting means for outputting a control signal for driving the three-way switching valve 23 to selectively establish communication between the absolute pressure sensor 25 with the interior space of the fuel tank 22 or the atmosphere, and a generated fuel evaporative emission amount detecting means for detecting amount of the fuel evaporative emission generated within the fuel tank 22.

Next, operation of the evaporative emission control system for preventing the fuel evaporative emission from being discharged into the atmosphere.

When the fuel evaporative emission is generated within the fuel tank 22 and the internal pressure in the fuel tank 22 is risen to be higher or equal to the predetermined pressure $P_o$, the check valve 29 is opened to introduce the fuel evaporative emission into the canister 34 through the communication passage 28 and the check valve 29. The emission component in the fuel evaporative emission gas is absorbed by the absorbent 34 in the canister 30.

Thereafter, when the ECU 50 makes a judgement that the engine driving condition permits introduction of the fuel evaporative emission into the air intake manifold 2, the control valve 40 is driven to open. While the control valve 40 is held open, the fresh air is introduced through the fresh air inlet opening 36 into the canister 30 by the effect of the vacuum pressure in the air intake manifold 2. By introducing the fresh air into the canister 30, the emission component of the fuel evaporative emission which is absorbed in the absorbent 34 is introduced into the air intake manifold 2 together with the fresh air. By this, the absorbent 34 is purged for repeated use. The fuel evaporative emission thus introduced into the air intake manifold 2 is combusted within the combustion chamber 16 together with the fuel injected through the fuel injection valve 26.

On the other hand, when the ECU 50 makes judgement that the driving condition of the engine is not suitable for introducing the fuel evaporative emission into the air intake manifold 2, the control valve 40 is operated to close. Then, the emission component in the fuel evaporative emission is absorbed by the absorbent 34 of the canister 30.

Next, the detecting system for detecting condition of the operation of the fuel evaporative emission, according to the present invention, will be discussed with reference to the flowchart of FIG. 3. It should be noted that the shown routine is initiated in response to turning ON of a key switch (not shown) and periodically or cyclically executed at every predetermined intervals (e.g. 60 ms).

At a step 100, the control signal is output to control the three-way valve 23 to establish communication between the atmosphere and the absolute pressure sensor 25. At a step 110, the atmospheric pressure Pa as detected by the absolute pressure sensor 25 is read out. The read out atmospheric pressure $P_a$ is stored in the RAM 56.

At a step 120, another control signal is output to switch the three-way switching valve 23 to establish communication between the fuel tank 22 and the absolute pressure sensor 25. At a step 130, the pressure $P_f$ within the fuel tank (hereafter referred to as "tank internal pressure") as detected by the absolute pressure sensor 25 is read out.

At a step 140, a pressure difference $P_{fa}$ of the tank internal pressure $P_f$ and the atmospheric pressure $P_a$ is derived by subtracting the atmospheric pressure $P_a$ stored in the RAM 56 from the tank internal pressure $P_f$. Namely, by this process, the pressure variation in the fuel tank 22 due to generation of the fuel evaporative emission, is detected.

Figure 9:
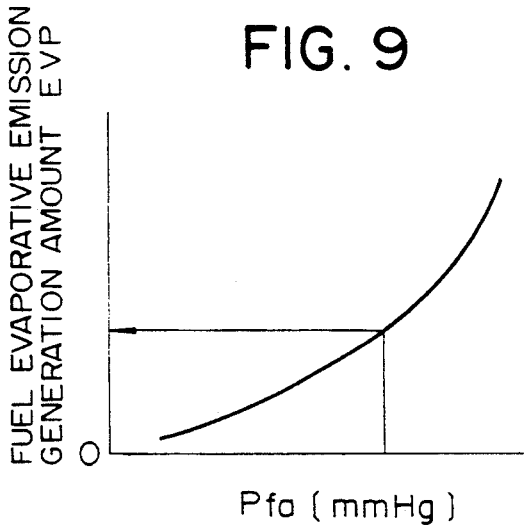
FIG. 9 is a graph showing relationship between a fuel evaporative emission generation amount and a pressure difference between the internal pressure of a fuel tank and the atmospheric pressure, which is used for discussion about operation of the flowchart of FIG. 4.

At a step 150, based on the value $P_{fa}$ derived at the step 140, the generation amount EVP of the fuel evaporative emission is derived through map look-up against a map shown in FIG. 9. The fuel evaporative emission generation amount EVP thus derives is stored in the RAM 56. Then, process returns to a main routine which governs overall operation of the ECU 50.

Accordingly, since the fuel evaporative emission generation amount EVP is derived on the basis of the difference $P_{fa}$ of the tank internal pressure $P_f$ and the atmospheric pressure $P_a$, the fuel evaporative emission generation amount EVP can be accurately derived irrespective of fluctuation of pressure in the fuel tank due to variation of the atmospheric pressure.

Figure 3:
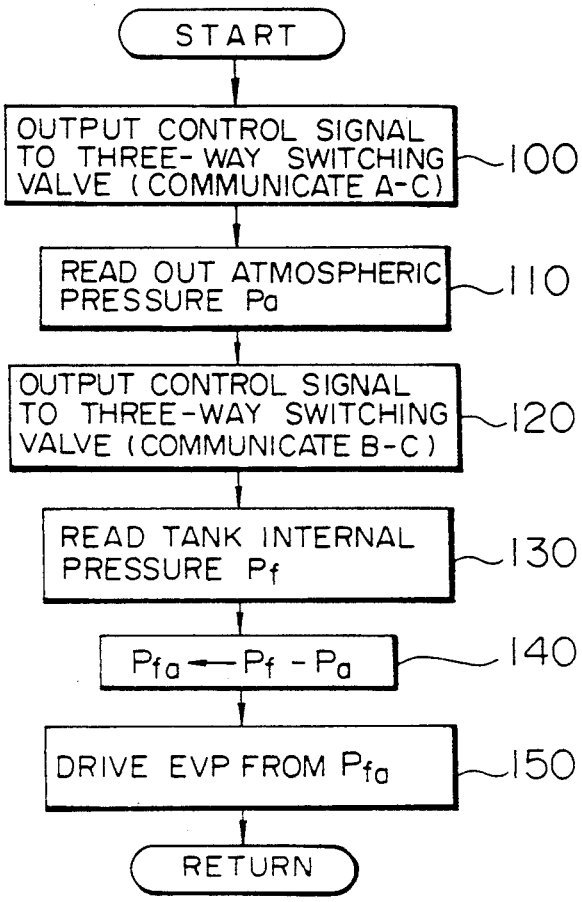
FIG. 3 is a flowchart showing operation for detecting generation amount of a fuel evaporative emission according to the present invention.
Figure 4:
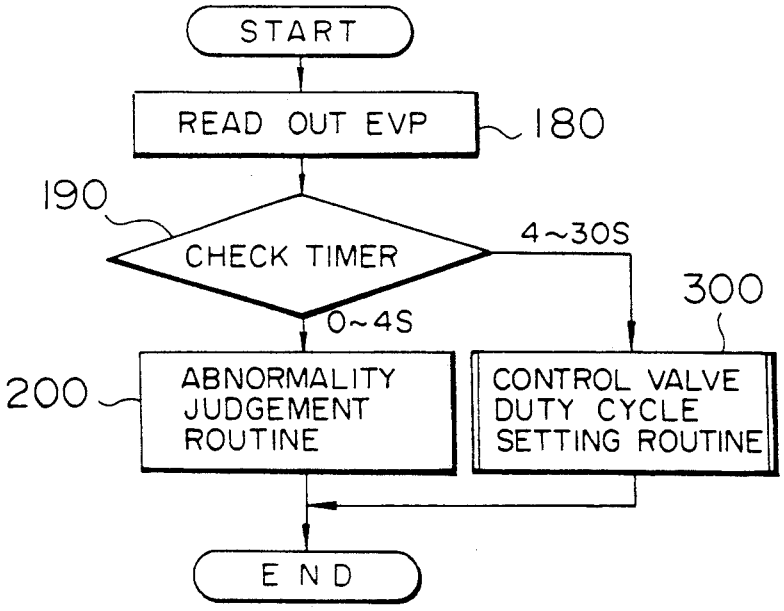
FIG. 4 is a flowchart showing operation for controlling the system shown in FIG. 2 on the basis of the generation amount of the fuel evaporative emission.

FIG. 4 shows a flowchart showing process for controlling respective control factors of the evaporative emission control system on the basis of the fuel evaporative emission generation amount EVP derived through the process set forth above. It should be noted that the routine of FIG. 4 is executed periodically or cyclically with a predetermined intervals (e.g. 60 ms) similarly to the routine of FIG. 3.

At a step 180, the fuel evaporative emission generation amount EVP which is derived through the step 150 of FIG. 3 and stored in the RAM 56 is read out. At a step 190, a timer (not shown) in the ECU 50 is checked. If the timer value indicates 0 to 4 sec, the process is advanced to a step 200 to perform abnormality judgement routine. On the other hand, if the time value indicates 4 to 30 sec., the process is advanced to a step 300 to perform a process for setting a duty cycle for opening and closing the control valve 40 on the basis of the fuel evaporative emission generation amount EVP.

Figure 5:
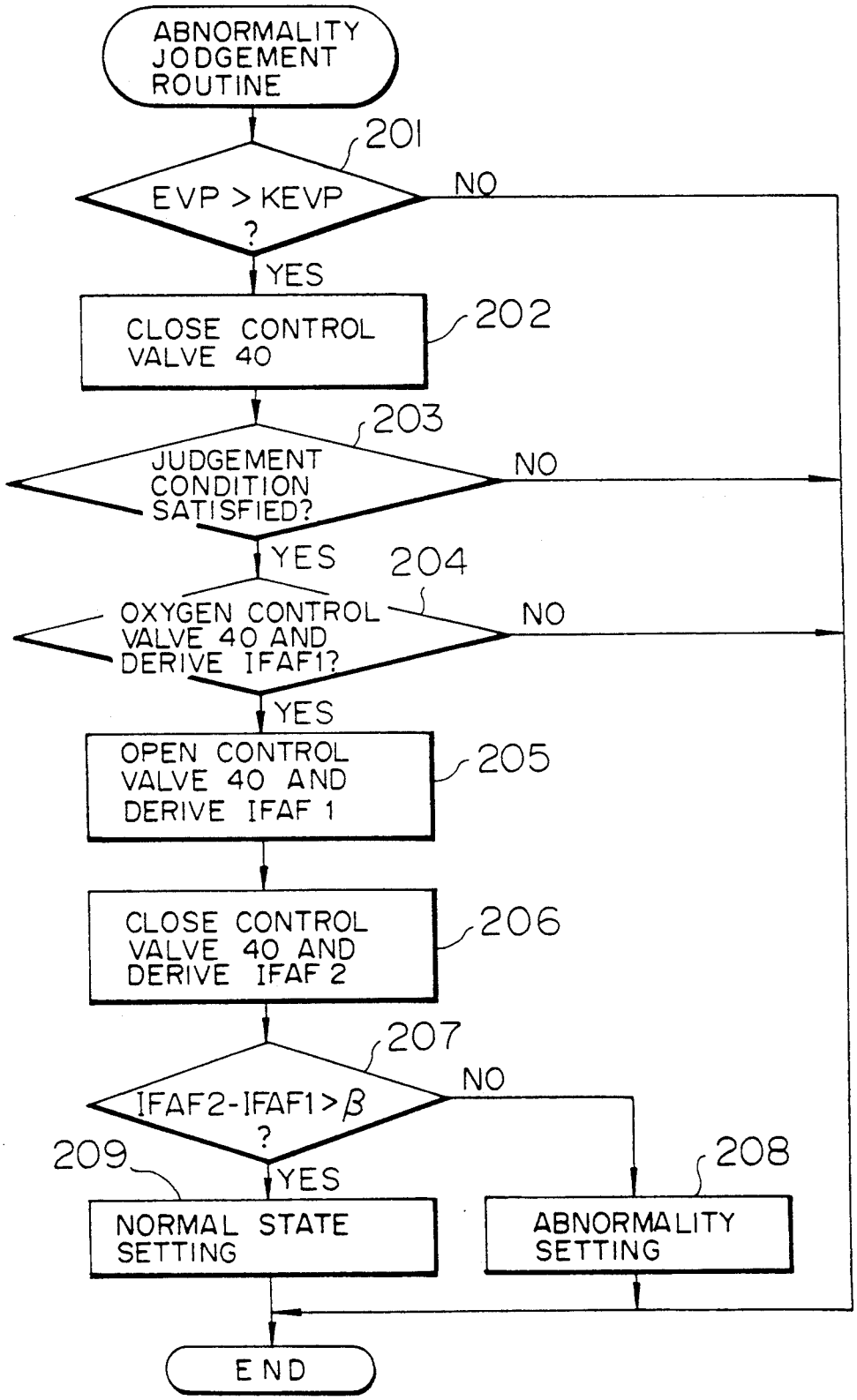
FIG. 5 is a flowchart showing detail of the process of the flowchart of FIG. 4.

FIG. 5 shows the detailed process in the abnormality judgement routine set forth above. At a step 201, the fuel evaporative emission generation amount EVP as derived at the step 150 is compared with a predetermined value KEVP to make judgement whether the sufficient amount of the fuel evaporative emission is generated within the fuel tank 22. If the fuel evaporative emission generation amount EVP is greater than or equal to the predetermined value KEVP, judgement is made that sufficient amount of the fuel evaporative emission is generated within the fuel tank 22 to advance the process to a step 202. On the other hand, when the fuel evaporative emission generation amount EVP is less than the predetermined value KEVP, judgement is made that the generated amount of the fuel evaporative emission is not sufficient. Then, the process is terminated.

It should be noted that, the predetermined value KEVP is selected so that the generated amount of the fuel evaporative emission EVP is sufficient to vary the air/fuel ratio of a mixture to be combusted within the combustion chamber 16 as introduced into the air intake manifold 2. This value is set through experiments with respect to each type of engine. On the other hand, the predetermined value KEVP is selected to be sufficiently larger than the fuel evaporative emission generation amount to establish the internal pressure $P_o$ of the fuel tank 22 sufficiently high for opening the check valve 29.

At a step 202, the control valve 40 is operated into the fully closed position. By this, introduction of the fuel evaporative emission into the air intake manifold 2 is disabled. At a step 203, check is performed whether a predetermined judgement condition is satisfied or not. If the predetermined judgement condition is satisfied, the process is advanced to a step 204. On the other hand, when the judgement condition is not satisfied, the process is terminated. Here, in the shown embodiment, the judgement condition is that a feedback correction coefficient FAF which is derived on the basis of the oxygen concentration in the exhaust gas as detected by the oxygen sensor, thus reflects rich/lean condition of the air/fuel mixture combusted within the combustion chamber 16 of the engine, and is used for deriving fuel injection amount, is within a predetermined range (for example, $0.7 < FAF < 1.2$).

Figure 7:
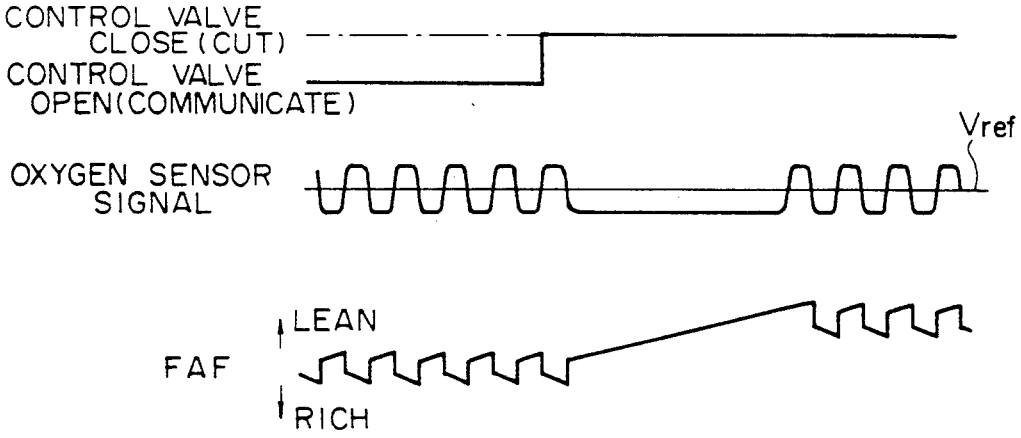
FIG. 7 is a chart showing operation in the process of the flowchart of FIG. 5.

At a step 204, check is performed whether the oxygen sensor 21 operates in normal state or not. If judgement is made that the oxygen sensor 21 is not operating in the normal state, the process is terminated. In this process, checking is performed whether the output signal of the oxygen sensor 21 is varying across criteria voltages V1 and V2 as shown in FIG. 7. When the output signal of the oxygen sensor 21 is varying across V1 and V2, judgement is made that the oxygen sensor is operating in normal state.

At step 205, the control valve 40 is operated to open. Then, an average value IFAF1 of the feedback correction coefficient FAF over n cycles (for example, $n=6$) after opening of the control valve 40 is calculated. Subsequently, the process is advanced to a step 206. At the step 206, the control valve 40 is closed. Then, an average value IFAF2 of the feedback correction coefficient FAF over n cycles after closing of the control valve 40 is calculated.

Figure 6:
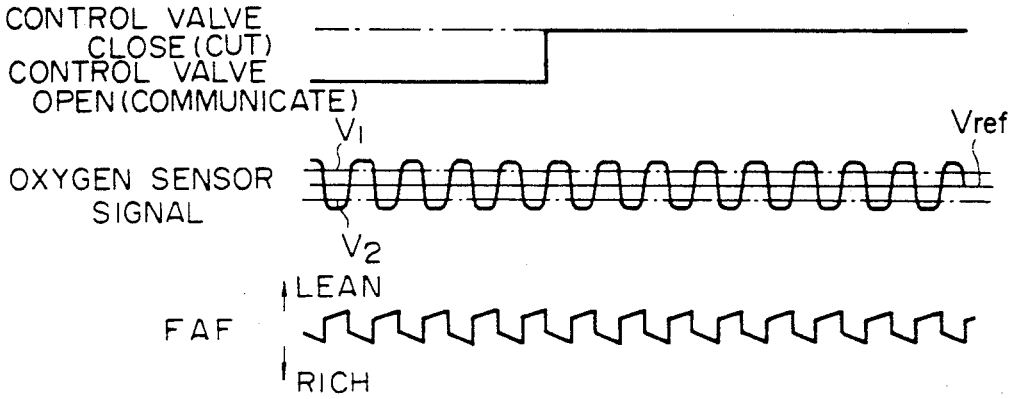
FIG. 6 is a chart showing operation in the process of the flowchart of FIG. 5.

At a step 207, the average values IFAF1 and IFAF2 are compared. When a difference between the average values IFAF1 and IFAF2 is greater than or equal to a predetermined value $\beta$, judgement can be made that the air/fuel mixture turns into lean by switching the control valve 40 from open state to closed state. In general, if the evaporative emission control system is in operation in the normal state, the air/fuel ratio is varied into lean by varying the state of the control valve 40 from open state to closed state, as shown in FIG. 6. Conversely, if abnormality, such as blocking of the supply passage 38 or 42, disconnection of the supply passage 38 or 42, the air/fuel ratio may not be varied even when the control valve 40 is switched from the open state to the closed state.

Accordingly, when the air/fuel ratio is held unchanged, namely, when the difference between the average values IFAF1 and IFAF2 is less than the predetermined value $\beta$, judgement is made that the evaporative emission control system causes abnormality. Then, the process is advanced at a step 208 to perform setting of abnormality, and subsequently the process is terminated.

The process of abnormality setting is performed to store information indicative of the fact that abnormality is caused, in the RAM 56. Then, through other routine which is not shown, the abnormality indicative information stored in the RAM 56 is processed in such a manner that the information stored in the RAM 56 is read out and integrated to make judgement that failure of the evaporative emission control system is caused when the abnormality information are continuously set over a given times (for example, three times), for example. When failure of the evaporative emission control system is judged, known fail-safe operation, such as triggering an indicator lamp 60, for alarming failure to the user of the vehicle, is taken place.

On the other hand, when the air/fuel ratio becomes lean as checked at the step 207, namely, when the difference of the average values IFAF1 and IFAF2 is greater than or equal to the predetermined value $\beta$, judgement can be made that the evaporative emission control system operates in the normal state. Then, process is advanced to a step 209. At the step 209, the normal state setting is performed, and subsequently, the process is terminated. Here, the normal state setting is the process for setting information that the evaporative emission control system is in operation in the normal state, in the RAM 56. This information is read out in the process of other routine for making judgement of failure of the evaporative emission control system set forth above, and used for resetting the integrated value.

Accordingly, by performing the process set forth above, judgement can be made whether failure is caused in the evaporative emission control system. At this time, by accurately detecting whether the sufficient amount of the fuel evaporative emission is generated to vary the air/fuel ratio, according to the present invention, erroneous detection of failure of the evaporative emission control system, which is otherwise caused when only insufficient fuel evaporative emission is generated while the evaporative emission control system operates in the normal state, can be successfully eliminated.

Figure 8:
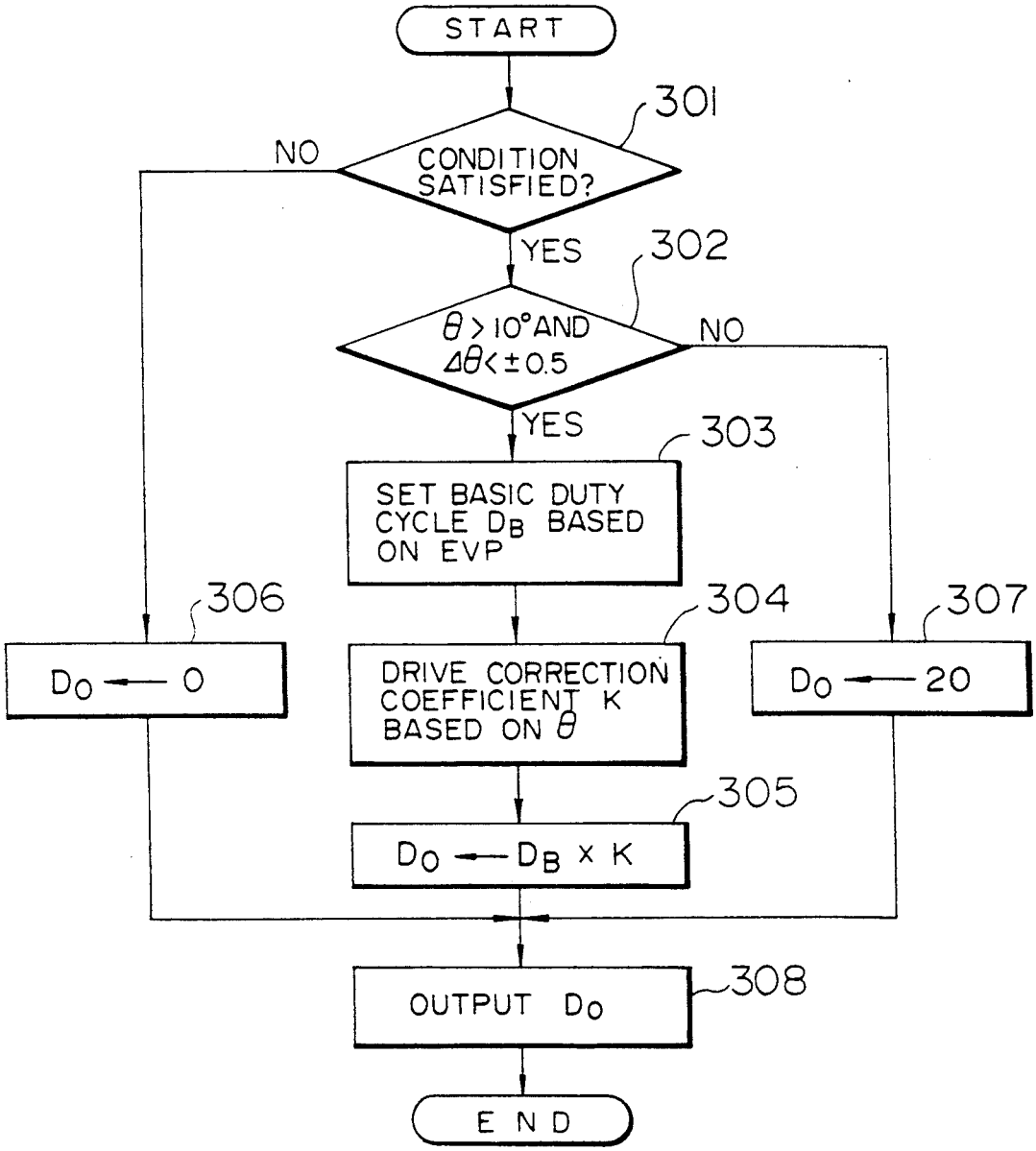
FIG. 8 is a flowchart showing operation for controlling the system shown in FIG. 2 on the basis of the generation amount of the fuel evaporative emission.

FIG. 8 shows a process for setting duty cycle for opening and closing the control valve on the basis of the fuel evaporative emission generation amount EVP as derived in the routine of FIG. 3.

At a step 301, judgement is made whether the engine operating condition permits duty cycle control for the control valve 40 depending upon the fuel evaporative emission generation amount EVP. When the engine driving condition is suitable for performing duty cycle control, the process is advanced to a step 302. On the other hand, when the engine driving condition is not suitable for performing the duty cycle control, the process is advanced to a step 306. At the step 306, the duty cycle $D_o$ is set to 0%. Then, process is advanced to a step 308.

It should be noted that the condition suitable for performing the duty cycle control is judged when a predetermined period (for example, 120 sec) is elapsed after turning ON the ignition switch, an engine coolant temperature is higher than a given temperature (e.g. 40° C.), the fuel supply system is not in the fuel cut-off state, and so forth, for example.

At the step 302, the angular position of the throttle valve 8 is checked to make judgement whether the throttle valve open angle $\theta$ is greater than a predetermined angle (e.g. 10°) and the variation amount $\Delta\theta$ of the throttle valve open angle $\theta$ is smaller than a predetermined value (e.g. 0.5°). When the condition is satisfied, the process is advanced to the step 303. On the other hand, when the above-mentioned condition is not satisfied, the process is advanced to a step 307, in which the duty cycle is set at 20%. Thereafter, the process is advanced to a step 308.

Figure 10:
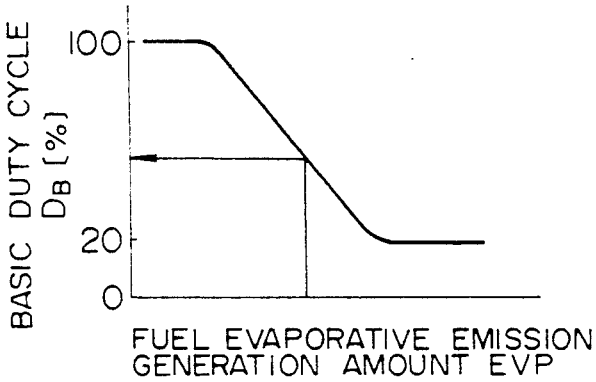
FIG. 10 is a graph showing relationship between a basic duty ratio and the fuel evaporation emission generation amount, which is used for discussion about operation of the flowchart of FIG. 8.

At the step 303, the basic duty cycle $D_B$ for the control valve 40 is set through a map look-up against a map of FIG. 10 in terms of the generated amount EVP of the fuel evaporative emission. Here, as shown in the map of FIG. 10, the duty cycle $D_B$ is determined to be smaller value according to increasing the generated amount EVP of the fuel evaporative emission.

Figure 11:
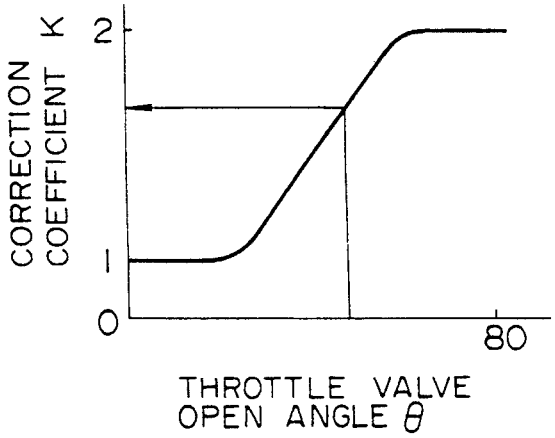
FIG. 11 is characteristic chart showing variation of a correction coefficient relative to a throttle valve open angle, which is used for discussion about operation of the flowchart of FIG. 8.

At a step 304, a correction coefficient K is derived through a map look-up against a map such as that illustrated in FIG. 11 in terms of the throttle valve open angle $\theta$. At a step 305, the duty cycle $D_o$ is derived by multiplying basic duty cycle $D_B$ with the correction coefficient K.

At a step 308, the duty cycle $D_o$ through the foregoing process is output. Subsequently, the process ends.

As set forth, by accurately detecting the generated amount EVP of the fuel evaporative emission in the fuel tank 22, and setting the duty cycle $D_o$ at a smaller value when a large amount of fuel evaporative emission is generated, it can prevent the engine combustioning condition from being excessively fluctuated by introduction of the fuel evaporative emission into the air intake manifold 2.

Furthermore, in the shown embodiment, since the three way switching valve 23 is provided so that the difference $P_{fa}$ of the tank internal pressure $P_f$ and the atmospheric pressure $P_a$ which are detected with the common pressure detecting means (absolute pressure sensor 25), the fuel evaporative emission generation amount EVP can be accurately derived irrespective of the temperature characteristics and secular variation of the absolute pressure sensor 25 per se.

It should be noted that though the shown embodiment accurately detects the generation amount EVP of the fuel evaporative emission in the fuel tank 22 and abnormality detection of the evaporative emission control system and setting of the duty cycle $D_o$ of the control valve 40 on the basis of the generated amount EVP of the fuel evaporative emission, it is possible to control other control factors using the generated amount EVP of the fuel evaporative emission.

On the other hand, although the shown embodiment detects the tank internal pressure $P_f$ and the atmospheric pressure $P_a$ by means of the common pressure detecting means (absolute pressure sensor 25), it is not specified to the shown construction. Namely, it is possible to separately provide the pressure detecting means for the atmospheric pressure $P_a$ and the pressure detecting means for the tank internal pressure $P_f$.

Furthermore, although the absolute pressure sensor 25 is employed as the pressure detecting means in the shown embodiment, it is possible to employ a relative pressure sensor, in place thereof.

As set forth above, according to the present invention, by detecting the generated amount of the fuel evaporative emission in the fuel tank on the basis of the result of detection by the atmospheric pressure detecting means and the tank internal pressure detecting means which detects the pressure within the fuel tank, the generated amount of the fuel evaporative emission in the fuel tank can be accurately detected irrespective of variation of the pressure in the fuel tank due to influence of the atmospheric pressure.

Figure 12:
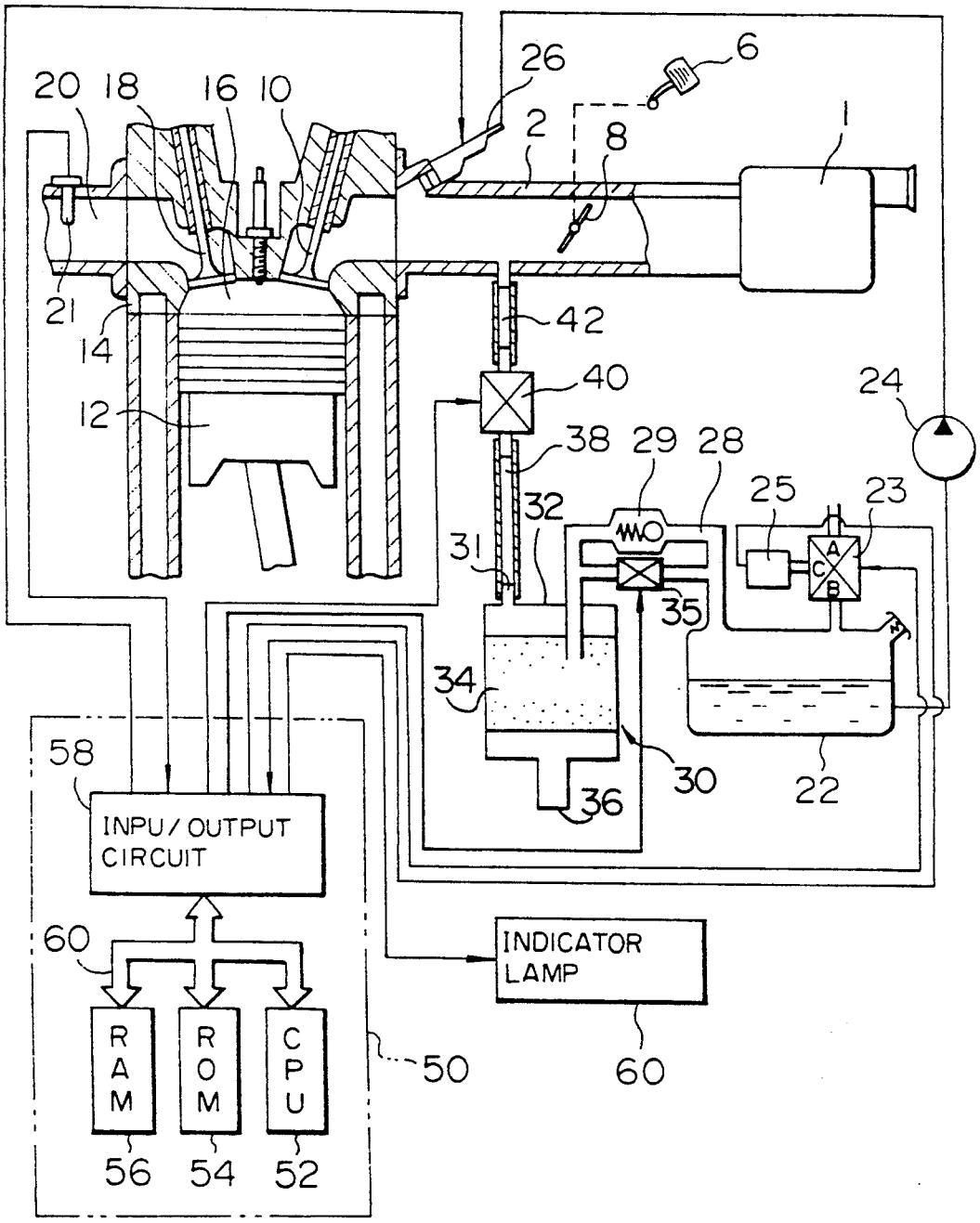
FIG. 12 shows an entire configuration of another embodiment of the present invention.
Figure 13:
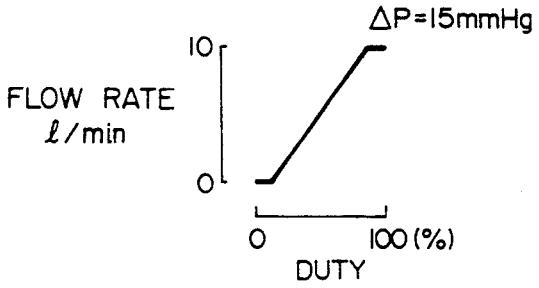
FIG. 13 shows a relation of duty ratio of a duty controllable valve and flow rate of fuel gas held in the embodiment in FIG. 12.

FIG. 12 shows an entire configuration of another embodiment of the present invention, which differs from that in FIG. 2 in coupling a duty control valve 35 in parallel with a check valve 29. With a feedback control of the duty ratio of the control valve 35 which is operated by a predetermined frequency (e.g., 10 Hz) so as to set at a target pressure difference (e.g., 15 mmHg) the difference atmospheric pressure and internal pressure of the fuel tank 22, an almost proportional relation holds as shown in FIG. 13 between duty ratio of the control valve 35 and flow rate of fuel vapor (fuel-vapor generation amount EVP) supplied from the fuel tank to the canister 34. Thus the flow rate of generated fuel gas can be detected by making use of the duty relation. Of course the check valve 29 is adapted to open at a pressure (e.g., 18 mmHg) higher than the above target pressure.

Figure 14:
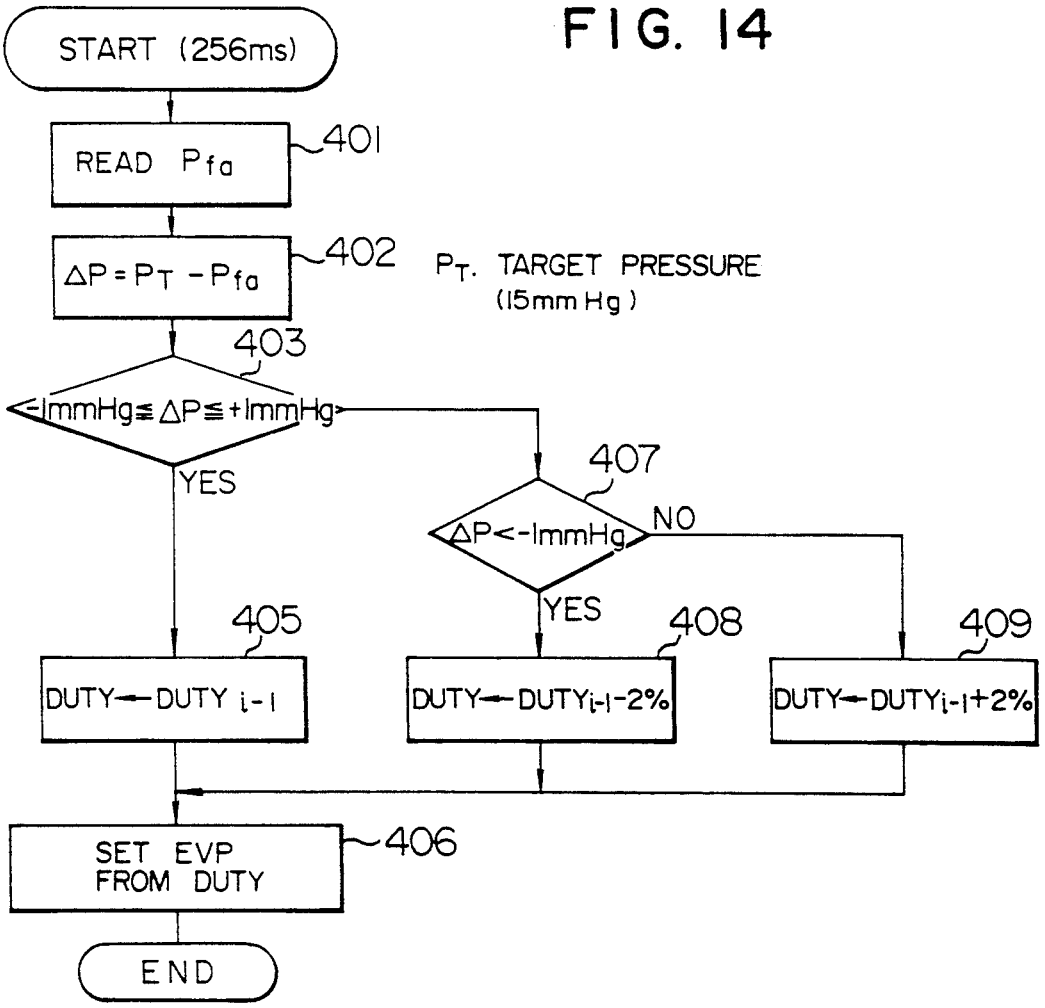
FIG. 14 is a flow chart for explaining operation of the duty controllable valve used in the embodiment.

FIG. 14 is a flowchart explaining operation of the control valve 35, which is performed instead of step 150 shown in FIG. 3 in the embodiment shown in FIGS. 3 to 5. Other steps can be shown by flowcharts identical with those shown in FIGS. 3 to 5. Step 401 is provided to read out pressure difference $P_{fa}$ calculated at step 140. Step 402 is to seek pressure deviation $\Delta p$ between target pressure $P_1$ and pressure difference $P_{fa}$, Step 403 is provided to check if pressure deviation $\Delta p$ is within a non-sensitive range $\pm 1$ mmHg to proceed to step 405 when detecting it within the range. Step 405 is to maintain a duty of control valve 35 same as a just-preceding cycle duty and proceed to step 406. Step 403 is to proceed to step 407 when detecting pressure deviation $\Delta p$ not within the range. Step 407 is to check if the deviation $\Delta p$ is lower than $-1$ mmHg ($\Delta p < -1$ mmHg) and proceed to step 408 when the deviation is lower than $-1$ mmHg (namely when the tank internal pressure is lower than the target pressure by a predetermined magnitude). Step 408 is provided to change duty of control valve 35 to duty value of a just-preceding cycle duty value minus a given magnitude (e.g., by 2%) and proceed to step 406. Step 407 is also to proceed to 409 when detecting pressure deviation $\Delta p$ is not lower than 1 mmHg ($\Delta p \geqq -1$ mmHg, namely when the tank internal pressure is higher than the target pressure by a predetermined magnitude). Step 409 is to change duty of control valve 35 to duty value of a just-preceding cycle duty value plus a given magnitude (e.g., 2%) and to proceed to step 406. Step 406 is provided to seek fuel gas generation amount EVP to be used at step 201 shown in FIG. 5 from the resultant duty value. Alternatively to FIG. 14 the gas generation amount EVP is sought at step 406, it may be possible to omit the step 406 in FIG. 14 on account that such duty value changes in approximately proportional relation to such fuel vapor generation amount EVP. An alternative way may be made of that of FIG. 5 modified by comparing a resultant duty ratio directly to a predetermined value and proceeding to step 202 with detection of the duty value not lower than the predetermined value, which is assumed as the fuel vapor generation amount EVP not lower than the corresponding predetermined value.

We claim:

1. In an engine introducing fuel from a fuel tank into a combustion chamber via an injector to combust an air-fuel mixture introduced from an intake manifold, a system for detecting an amount of fuel vapor generated in the fuel tank, the system comprising:

pressure detecting means for selectively detecting atmospheric pressure and fuel vapor pressure generated in the fuel tank;

passage switching means for selectively switching between first and second passages for communicating said pressure detecting means with atmospheric pressure and the fuel vapor pressure in the fuel tank respectively; and fuel-vapor amount detection means for controlling said switching means and detecting an amount of generated fuel vapor on the basis of an atmospheric pressure and a fuel gas pressure respectively detected by said pressure detecting means.

2. A system according to claim 1, wherein said passage switching means comprises a three-way switching valve having a first communication portion exposed to atmosphere, a second communication portion communicating with an interior of the fuel tank and a third communication portion communicating with the pressure detecting means, said three-way switching valve being adapted to selectively communicate said pressure detecting means to either atmosphere or the interior of the fuel tank; and said fuel-vapor amount detection means comprises operation control means for generating a signal to selectively control said three-way switching valve to cause the communication of atmosphere and said pressure detecting means and to cause the communication of the fuel tank and said pressure detecting means, wherein said operation control means includes means for reading fuel vapor pressure generated in said tank and atmospheric pressure respectively detected by said pressure detecting means via the controlled switching valve means, and means for calculating the amount of generated fuel vapor on the basis of read pressure values.

3. A system according to claim 1, further including a canister provided in a communication passage joining the fuel tank and the intake manifold, said canister containing absorbent therein for absorbing fuel vapor evaporated from fuel in the tank; and a check valve provided in a communication passage joining the canister and the fuel tank, said check valve being adapted to open in response to a pressure that is greater than atmospheric pressure.

4. A system according to claim 2, further including a canister provided in a communication passage joining the fuel tank and the intake manifold, said canister containing therein absorbent for absorbing fuel vapor evaporated from fuel in the tank; and a check valve provided in a communication passage joining the canister and the fuel tank, said check valve being adapted to open in response to a pressure that is greater than atmospheric pressure.

5. A system according to claim 4, further including a controllable valve provided in a communication passage joining the canister and the intake manifold and adapted to be controlled from said operation control means.

6. A system according to claim 1, wherein said fuel-vapor amount detecting means detects on the basis of a difference between atmospheric pressure and generated fuel vapor pressure detected by said pressure detecting means.

7. A system according to claim 1, further including a canister provided in a communication passage joining said fuel tank and said intake manifold, said canister containing therein absorbent for absorbing generated fuel vapor;

a controllable valve provided in a communication passage joining said canister and said intake manifold, said controllable valve being adapted to be controlled from said fuel-vapor amount detecting means; wherein said fuel-vapor amount detecting means includes operation control means having means for closing said controllable valve when the detection of amount of generated fuel vapor exceeds a predetermined amount, means for opening said controllable valve by detecting a predetermined condition of engine operation caused under state of the closed controllable valve, means for calculating a first value of a preselected engine-operating condition when the controllable valve is open, means for calculating a second value of the preselected engine-operating condition when the controllable valve is closed, and means for comparing the calculated first and second values to identify a normal operating condition and an abnormal operating condition of the engine.

8. A system according to claim 7, wherein the values of said preselected engine-operating condition are selected as average values of feedback correction coefficient values calculated in updating cycles of engine operating conditions.

9. A system according to claim 2, wherein said operation control means includes:

means for checking the detected amount of generated fuel vapor when said controllable valve is controlled under a duty ratio control;

means responsive to a checked result of said valve under the duty ratio control and adapted to set a duty ratio for control on the basis of the detected amount of generated fuel vapor and detected operating conditions of a throttle valve provided in said intake manifold.

10. A system according to claim 5, wherein said operation control means includes:

means for checking the detected amount of generated fuel vapor when said controllable valve is controlled under a duty ratio control;

means responsive to a checked result of said valve under the duty ratio control and adapted to set a duty ratio for control on the basis of the detected amount of generated fuel vapor and detected operating conditions of a throttle valve provided in said intake manifold.

11. A system according to claim 7, wherein said operation control means includes:

means for checking the detected amount of generated fuel vapor when said controllable valve is controlled under a duty ratio control;

means responsive to a checked result of said valve under the duty ratio control and adapted to set a duty ratio for control on the basis of the detected amount of generated fuel vapor and detected operating conditions of a throttle valve provided in said intake manifold.

12. In an engine introducing fuel from a fuel tank into a combustion chamber to combust an air-fuel mixture introduced from an intake manifold, a system for detecting an amount of fuel vapor, the system comprising:

a canister containing absorbent therein for absorbing fuel vapor generated in the fuel tank;

means for detecting deviation of internal pressure in the fuel tank from atmospheric pressure;

duty control valve means for opening and closing a communication passage between the fuel tank and the canister;

duty control means for feed-back controlling duty of the duty control valve means so as to detect the deviation of the fuel tank internal pressure at a target deviation value; and means for determining the amount of generated fuel vapor on the basis of feedback controlled duty of the duty control means.

13. A system according to claim 12, wherein said pressure deviation detecting means comprises:

means for detecting pressure internal of the fuel tank;

means for detecting atmospheric pressure; and deviation calculation means for subtracting the detected atmospheric pressure from the detected tank internal pressure to calculate pressure deviation.

* * * * *